US009254980B2

(12) United States Patent
Ahne et al.

(10) Patent No.: US 9,254,980 B2
(45) Date of Patent: Feb. 9, 2016

(54) METHOD FOR OPERATING AN IMAGING DEVICE WITH A FAILED MEDIA BIN LEVEL SENSOR

(71) Applicant: Lexmark International, Inc., Lexington, KY (US)

(72) Inventors: Adam Jude Ahne, Lexington, KY (US); Mark Stephen Underwood, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/083,713

(22) Filed: Nov. 19, 2013

(65) Prior Publication Data

US 2015/0139670 A1 May 21, 2015

(51) Int. Cl.

| | |
|---|---|
| ***B65H 43/08*** | (2006.01) |
| ***B65H 31/00*** | (2006.01) |
| ***G03G 15/00*** | (2006.01) |

(52) U.S. Cl.

CPC ..... *B65H 43/08* (2013.01); *G03G 15/6552* (2013.01); *G03G 15/70* (2013.01); *B65H 2511/152* (2013.01); *B65H 2553/412* (2013.01); *G03G 2215/00911* (2013.01)

(58) Field of Classification Search

CPC ..... B65H 43/08; B65H 2553/512; B65H 2511/152; B65H 2553/12; B65H 2511/1524; G03G 2215/00911

See application file for complete search history.

(56) References Cited

U.S. PATENT DOCUMENTS

| | | | | |
|---|---|---|---|---|
| 4,797,548 | A * | 1/1989 | Kobbing et al. | 250/221 |
| 5,283,424 | A * | 2/1994 | Acquaviva et al. | 250/205 |
| 5,805,292 | A * | 9/1998 | Fournier et al. | 356/429 |
| 2006/0177236 | A1 * | 8/2006 | Kowari et al. | 399/88 |
| 2014/0084536 | A1 * | 3/2014 | Matos et al. | 271/145 |
| 2014/0210899 | A1 * | 7/2014 | Barnes et al. | 347/19 |

FOREIGN PATENT DOCUMENTS

| | | | | |
|---|---|---|---|---|
| JP | 2010155676 | A * | 7/2010 | B65H 31/00 |

* cited by examiner

*Primary Examiner* — Daniel J Colilla
(74) *Attorney, Agent, or Firm* — John Victor Pezdek

(57) ABSTRACT

A method of operating an imaging device having a failed or failing media-full sensor determines whether or not a controller can trust the output signal received from the media-full sensor. A reduced power or intensity level is used to test the media-full sensor and, in particular, the light source to counter the dimming of the light source that occurs due to aging and electrical noise in the system. When the output signal of a photoreceptor is at or below a threshold value, the photo-receptor is considered to have not detected the light beam from the light source and the light beam is deemed not to have been detected even though the photo-receptor may be providing a lower level output signal. Thus, an output signal of the photo-receptor is not trusted and an indication that a media storage area is not full is provided and an imaging operation is carried out.

18 Claims, 4 Drawing Sheets

METHOD FOR OPERATING AN IMAGING DEVICE WITH A FAILED MEDIA BIN LEVEL SENSOR

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to control of sensors used in imaging devices such as printers and scanners, and more particularly to control of a failing or failed sensor allowing for continued operation of the imaging device.

2. Description of the Related Art

A media-full sensor is used to tell the controller in an imaging device when the output bin is full so the imaging device can pause printing or scanning This stops the imaging device from ejecting pages into the output bin that may push previous pages onto the floor. This also prevents paper jams caused by the peek-a-boo duplexer jamming paper into a stack in the output bin. In one form the media-full sensor comprises an infrared LED and a photo-transistor positioned on opposite sides of the bin that are separated by approximately 24 cm. The LED and photo-transistor are typically positioned transverse to the media path. The LED emits an infrared beam that with the media bin not full reaches the photo-transistor actuating the photo-transistor to change its state.

In Table 1, a truth table shows the digitized photo-transistor output of the media-full sensor for various fill conditions in the output bin and operational states of the LED.

TABLE 1

| Condition | Digitized Photo-Transistor Output |
|---|---|
| Bin is empty | Low (light reaches the photo-transistor) |
| Bin is partially full | Low (light reaches the photo-transistor) |
| Bin is full | High (no light reaches the photo-transistor) |
| LED is broken, bin is empty | High (no light reaches the photo-transistor) |
| LED is broken, bin is full | High (no light reaches the photo-transistor) |

The truth table shows a problem with this sensor: a broken or failing LED looks just like a bin full condition. Thus, the imaging device will stop when the LED fails or breaks. The imaging device will refuse to operate until a service person goes onsite and fixes the sensor. A failed LED is one which emits no light or emits a light at such a low level that it is of insufficient intensity to activate the photo-transistor. It should also be stated that the photo-transistor may also fail instead of the LED but the LED is orders of magnitude more likely to fail first due to the higher currents and higher heat involved with energizing the LED to emit a light beam that will reach the photo-transistor on the opposite side of the output bin.

Also field experience has soon that failure of the bin full sensor due to a failed photo-transistor is extremely rare. What is needed is a method that allows the media-full sensor to fail gracefully, i.e., a soft failure, such that a failed sensor does not stop the imaging device.

SUMMARY

Disclosed is a media of operating an imaging device having a media-full sensor for a media storage area. The media-full sensor has a light source and a spaced apart photo-receptor aligned therewith at a predetermined height above a floor of the media storage area. The photo-receptor provides an output signal indicative that the media storage location is one of full of media and not full of media. The method comprises emitting from the light source a light beam at a first intensity; determining whether or not the light beam at the first intensity has been detected by the photo-receptor; and, upon determining that the light beam at the first intensity has not been detected not trusting the output signal from the photo-receptor and providing an indication that the media area is not full. Further upon determining that the light beam at the first intensity has not been detected, an imaging operation may go forward. When the light beam at the first intensity is detected, an indication that the media storage area is not full is provided. Next a light beam from the light source is emitted at a second intensity that is greater than the first intensity and a determination is made whether or not the light beam at the second intensity has been detected by the photo-receptor. Upon determining that the light beam of the second intensity has been detected, the output signal from the photo-receptor is trusted, an imaging operation proceeds, and an indication that the media area is not full is provided. Upon determining that the beam of the second intensity has not been detected, an indication that the media area is full is provided and suspension of the imaging operation occurs.

BRIEF DESCRIPTION OF THE DRAWINGS

The above-mentioned and other features and advantages of the disclosed to embodiments, and the manner of attaining them, will become more apparent and will be better understood by reference to the following description of the disclosed embodiments in conjunction with the accompanying drawings.

DETAILED DESCRIPTION

Figure 1:
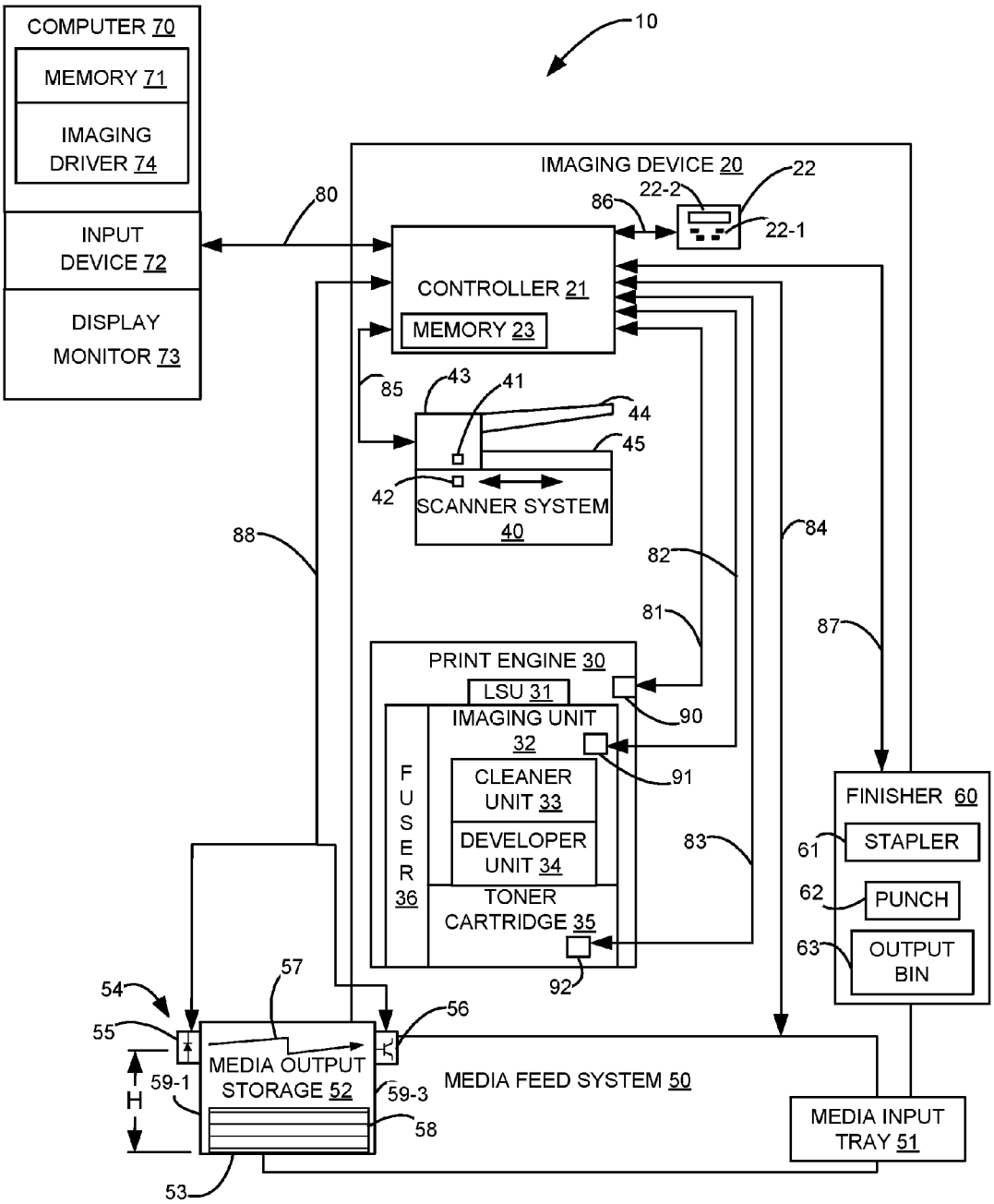
FIG. 1 is a schematic representation of an imaging device.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the present disclosure and that other alternative mechanical configurations are possible.

It will be further understood that each block of the diagrams, and combinations of blocks in the diagrams, respectively, may be implemented by computer program instructions. These computer program instructions may be loaded onto a general purpose computer, special purpose computer, or other programmable data processing apparatus to produce a machine, such that the instructions which execute on the computer or other programmable data processing apparatus may create means for implementing the functionality of each block or combinations of blocks in the diagrams discussed in detail in the descriptions below.

These computer program instructions may also be stored in a non-transitory, tangible, computer readable storage medium that may direct a computer or other programmable data processing apparatus to function in a particular manner, such that the instructions stored in the computer readable storage medium may produce an article of manufacture including an instruction means that implements the function specified in the block or blocks. Computer readable storage medium includes, for example, disks, CD-ROMS, Flash ROMS, non-volatile ROM and RAM. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus implement the functions specified in the block or blocks. Output of the computer program instructions may be displayed in a user interface of an imaging device or computer display of the computer or other programmable apparatus that implements the functions or the computer program instructions.

The term "image" as used herein encompasses any printed or digital form of text, graphic, or combination thereof. A printed image may be scanned to form an electronic image. The term "output" as used herein encompasses output from any imaging device such as color and black-and-white copiers, color and black-and-white printers, scanners, and multifunction devices that incorporate multiple functions such as scanning, copying, and printing capabilities in one device. Such imaging devices may utilize ink jet, dot matrix, dye sublimation, laser, and any other suitable print formats. The term button as used herein means any component, whether a physical component or graphic user interface icon, that is engaged to initiate an action or event.

Referring now to the drawings and particularly to FIG. 1, there is shown a block diagram depiction of an imaging system 10 according to one example embodiment. Imaging system 10 includes an imaging device 20 and a computer 70. Imaging device 20 communicates with computer 70 via a communication link 80. As used herein, the term "communication link" generally refers to any structure that facilitates electronic communication between two or more components and may operate using wired or wireless technology and may include communications over the Internet. Imaging device 20 may communicate with computer 70 via a standard communication protocol, such as for example, universal serial bus (USB), Ethernet or IEEE 802.xx. Imaging device 20 may also be, for example, a standalone electrophotographic printer/copier, a thermal transfer printer/copier, an ink jet printer/copier, or a stand alone scanner.

In the example embodiment shown in FIG. 1, imaging device 20 is a multifunction machine (sometimes referred to as an all-in-one (AIO) device) that includes a controller 21, a user interface 22, a print engine 30, a scanner system 40, a media feed system 50, and a finisher 60. Print engine 30 may include a laser scan unit (LSU) 31, an imaging unit 32 having a cleaner unit 33, a developer unit 34, a toner cartridge 35, and a fuser 37. Scanner system 40 may include one or more scan bars 41, 42, an automatic document feeder (ADF) 43 and its own media input and output trays 44, 45. ADF 43 moves media to be scanned from input tray 44, past scan bars 41, 42 where single or double sided scanning may occur, to output tray 44. Scan bar 41 is shown mounted in ADF 43 while scan bar 42 is shown mounted in the base of scanner 40 and is movable in a reciprocating manner as indicated by the double headed arrow. Media feed system 50 includes a media input tray 51 and an media output bin 52 and controls the feeding of media from media input tray 51 through print engine 30 to output bin 52 using pick mechanisms and feed rolls as is known in the art. The output of ADF 43 may also be fed to output bin 52 using media feed system 50. Finisher 60 includes a stapler 61, hole punch 62 and an output bin 63 for media that has been stapled and/or hole-punched.

Controller 21 includes a processor unit and associated memory 23 and may be formed as one or more Application Specific Integrated Circuits (ASICs). Memory 23 may be any volatile or non-volatile memory or combination thereof such as, for example, random access memory (RAM), read only memory (ROM), flash memory and/or non-volatile RAM (NVRAM). Alternatively, memory 23 may be in the form of a separate electronic memory (e.g., RAM, ROM, and/or NVRAM), a hard drive, a CD or DVD drive, or any processing device convenient for use with controller 21. Controller 21 may be, for example, a combined printer and scanner controller.

In the example embodiment illustrated, controller 21 communicates with print engine 30 and processing circuitry 90 via a communication link 81. Controller 21 communicates with imaging unit 32 and processing circuitry 91 thereon via a communication link 82. Controller 21 communicates with toner cartridge 35 and processing circuitry 92 thereon via a communication link 83. Controller 21 communicates with media feed system 38 via a communication link 84. Controller 21 communicates with scanner system 40 via a communication link 85. User interface 22 is communicatively coupled to controller 21 via a communication link 86 and to finisher 60 via communication link 87. Processing circuitry 90-92 may provide authentication functions, safety and operational interlocks, operating parameters and usage information related to print engine 30, imaging unit 32 and toner cartridge 35, respectively. Controller 21 processes print and scan data and operates print engine 30 during printing and scanner system 40 during scanning While multiple communication links are shown, a single communication link between controller 21 and each of the other components that it controls or communicates with may be used as is known in the art.

Computer 70, which is optional, may be, for example, a personal computer, to network server, tablet computer, smartphone, or other hand-held electronic device including memory 71, such as volatile and/or non volatile memory, an input device 72, such as a keyboard and/or a mouse, and a display 73, such as a monitor. Computer 70 also includes a processor, input/output (I/O) interfaces, and may include at least one mass data storage device, such as a hard drive, a CD-ROM and/or a DVD unit (not shown). Computer 70 includes in its memory 71 a software program including program instructions that function as an imaging driver 74, e.g., printer/scanner driver software, for imaging device 20. Imaging driver 74 is in communication with controller 21 of image forming device 22 via communication link 80. Imaging driver 74 facilitates communication between image forming device 20 and computer 70. One aspect of imaging driver 74 may be, for example, to provide formatted print data to imaging device 20, and more particularly to print engine 30, to print an image. Another aspect of imaging driver 66 may be, for example, to facilitate collection of scanned data from scanner system 40.

In some circumstances, it may be desirable to operate imaging device 20 in a standalone mode. In the standalone mode, imaging device 20 is capable of functioning without computer 70. Accordingly, all or a portion of imaging driver 74, or a similar driver, may be located in controller 21 so as to accommodate printing and/or scanning functionality when operating in the standalone mode.

Print engine 30 includes laser scan unit (LSU) 31, toner cartridge 35, imaging unit 32, and a fuser 37, all mounted within image forming device 22. Imaging unit 32, cleaner unit 33 developer unit 34 and toner cartridge 35 are supported in their operating positions by a frame which allows for toner cartridge 35 to be operatively mated to the imaging unit 32 while minimizing any unbalanced loading forces by the toner cartridge 35 on imaging unit 32. Imaging unit 32, cleaner unit 33, developer unit 34 and toner cartridge 35 may be removably mounted in the frame to allow for replacement. Developer unit 34 houses a toner sump and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. An exit port on toner cartridge 35 communicates with an entrance port on developer unit 34 allowing toner to be periodically transferred from toner cartridge 35 to resupply the toner sump in developer unit 34 which supplies charged toner to the photoconductive drum in cleaner unit 33.

The electrophotographic imaging process is well known in the art and, therefore, will be only briefly described. During an imaging operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred, either directly or through an intermediate transfer belt, to a media sheet received in imaging unit 32 from media input tray 51. Next, the toned image is fused to the media sheet in fuser 37 using heat and/or pressure and sent to an output storage area 52 or to one or more finishing options such as a duplexer or finisher 60. Toner remnants are removed from the photoconductive drum by the waste toner removal system housed within cleaner unit 33. As toner is depleted from developer unit 34, toner is transferred from toner cartridge 35 into developer unit 34. Controller 21 provides for the coordination of these activities occurring during the imaging process.

Shown on media output storage area 52 is a media-full full sensor 54 comprised of light source 55, such as LED 55 and photo-receptor 56, such as photo-transistor 56, which are shown in operative communication with controller 21 via communication link 88. Media-full sensor 54 is shown positioned a predetermined height H above the floor or bottom 53 of media output storage area 52. Media sensors similar to media sensor 54 may also be provided on output bins 45, 63 and be communicatively coupled to controller 21 via a communication link. When energized, LED 55 emits a light beam 57, such as an infrared light beam to photo-transistor 56. If the path between LED 55 and photo-transistor 56 is not blocked due to a output stack 58 of media of a height sufficient to block light beam 57, photo-transistor 56 will be actuated by light beam 57 and its output signal will change state which will be detected by controller 21 as previously set forth in the top three rows of Table 1 during normal functioning of media-full sensor 54. As previously discussed, light beam 57 is, in one form, of an infrared wavelength to which photo-transistor 56 is tuned so as to mitigate the effects of any natural or office light that may be present on photo-transistor 56. Other wavelengths of light may also be used.

Figure 2:
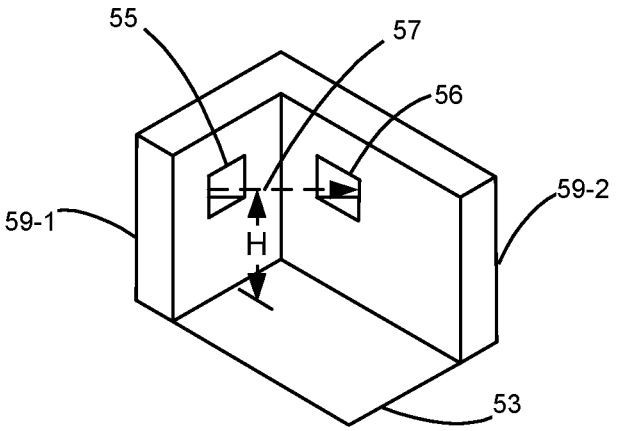
FIG. 2 is an alternative arrangement of a bin level sensor.

Light source 55 and photo-receptor 56 may be positioned on opposite sides 59-1, 59-3 of media storage area 52. Alternatively, as shown in FIG. 2, light source 55 and photo-receptor 56 may be positioned on adjacent sides 59-1, 59-2 of media storage area 52 and a predetermined height H above floor 53.

Figure 3:
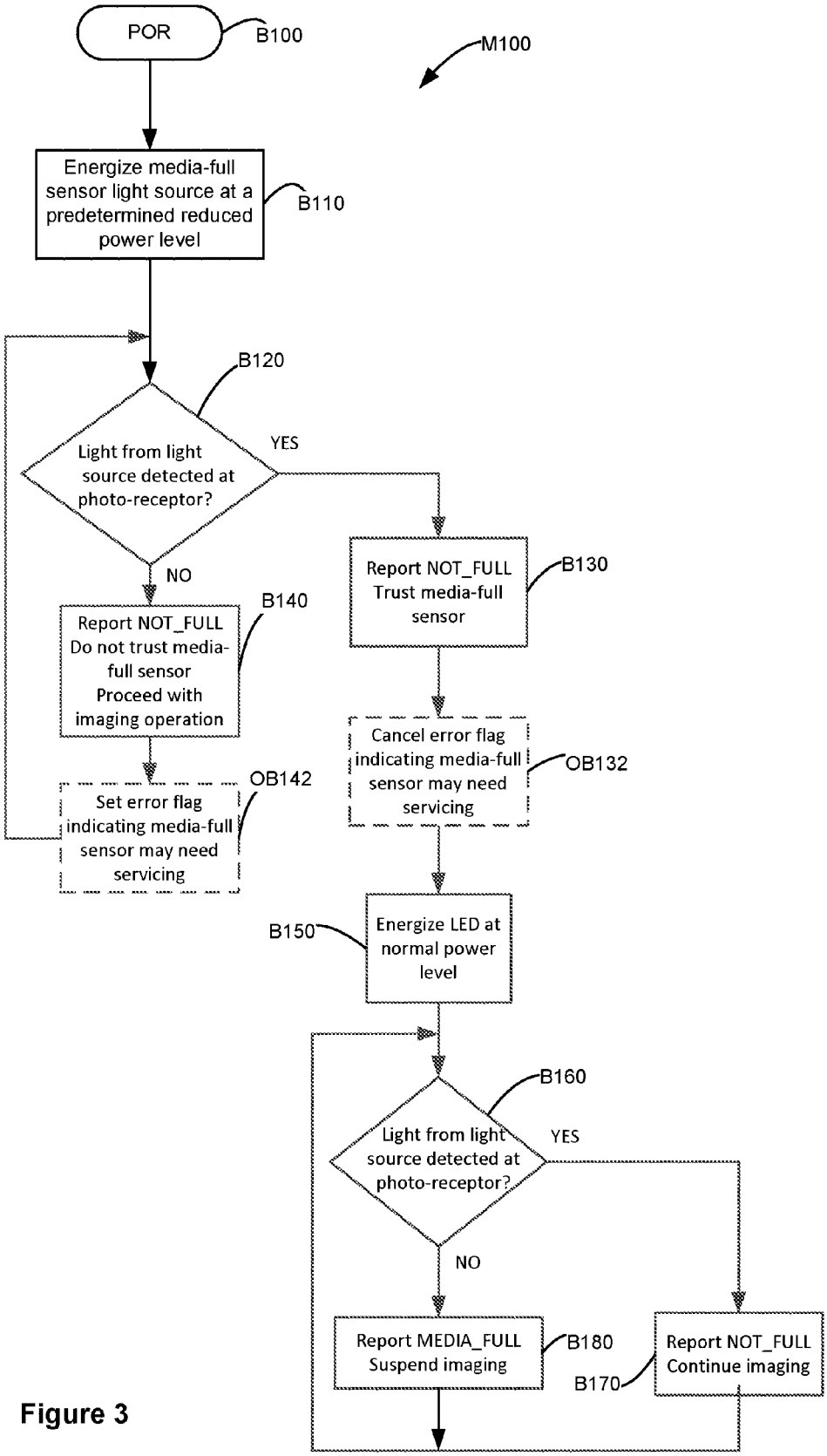
FIG. 3 is a block diagram of one form of a method to provide for a soft fail of a media bin full sensor.

As implemented in controller 21, the present method is used to determine to whether or not the controller 21 can trust the output signal that it is receiving from the media-full sensor 54. Referring to FIG. 3, method M100 starts whenever the imaging device 20 performs a power on reset (POR) procedure at block B 100. A POR occurs after power is turned off to imaging device 20 or to a subassembly within imaging device 20, such as the imaging unit 30, fuser 40, scanning system 60, imaging device 20 being placed in a reduced power or hibernation mode during periods of non-usage, etc. PORs also occur following the restoration of power after the occurrence of an event such as when a open door on the imaging device is opened then closed, when an error condition occurs and is acknowledged, when a user turns off or unplugs the imaging device and the turns the imaging device back on, when a media tray is removed then reinserted. This list of POR events is meant to be illustrative only as a POR may also occur for other reasons as those of ordinary skill in the art would appreciate.

After a POR has been performed, method M100 assumes that media-full sensor 54 has failed, i.e., light source 55 has gone dark or is emitting a light beam 57 at too low of an intensity so that the response of photo-receptor 56 is a signal that is of too low a value to exceed a threshold value. Controller 21 does not trust the output signal of photo-receptor 56, until the photo-receptor 56 is actuated by the light beam 57 and its output signal changes state to indicate that the light beam 57 has been detected. At block B 110, because controller 21 does not yet trust the output from media-full sensor 54, controller 21 energizes light source 55 at a reduced intensity or power level that is sufficient to actuate photo-receptor 56 but is less than the normal operating intensity level. For example, if light source 55 is normally driven using pulse width modulation at a 100 percent duty cycle, then at block B 110 light source 55 may be driven at a 80 percent or 90 percent duty cycle. The actual reduced intensity level that is used is empirically determined but is chosen to be at or above the minimum power level needed for the photo-receptor 56 to be actuated.

A reduced power or intensity level is used to test media-full sensor 54 and, in particular, light source 55 to counter the dimming of light source 55 that occurs due to aging and electrical noise in the system. As is known in the art, the output signal of photo-receptor 56 is an analog signal that increases from a zero level to a maximum level as the intensity of the light beam increases from a zero value to a maximum value. The analog signal is digitized by sending it to a comparator set at a threshold voltage so that the output signal of the photo-receptor 56 will be in one of two states. For example, if the maximum output of to photo-receptor 56 is +5 volts when a light beam of maximum intensity is sensed, the comparator may be set at a threshold value of about +2.5 volts. A light beam 57 having an intensity sufficient to cause photo-receptor 56 to produce an output signal that is above +2.5 volts will be considered to have actuated photo-receptor 56 and that the light beam 57 has been detected. When the output signal of photo-receptor 56 is at or below this threshold value, then photo-receptor 56 is considered to have not detected light beam 57 from light source 55 and the light beam is deemed not to have been detected even though the photo-receptor may be providing a lower level output signal. When light source 55 is new, energizing light source 55 at reduced power level, such as 80 to 90 percent of normal operating power, will not affect the ability of the light beam 57 that it produces to actuate photo-receptor 56 and the light beam 57 will still be detected. Even at such reduced power level, the light output of the new light source 55 will be such that the output of photo-receptor 56 will be well above the threshold value. However, as light source 55 ages, at normal power level, the light beam intensity of the older light source 55 decreases. This in turn means less light reaches photo-receptor 56 reducing the output of photo-receptor 56 so that its output signal may be near the threshold value where a small amount of electrical noise, such as +/−1 millivolt (my) may cause the comparator, in one case, e.g. +1 my, to decide that photo-receptor 56 has been actuated by light source 55 and in the other case, e.g. −1 my decide that it has not. So performing the test of media full sensor 54 at the reduced intensity level may result in the light beam 57 of the older light source 55 not being "detected" by photo-receptor 56 and thus provide an indication to imaging device 20 that the media-full sensor 54 is failing.

At block B 120 a determination is made whether or not photo-receptor 56 has detected the first or reduced intensity light from light source, or has light source 55 produced a light beam 57 of sufficient intensity to actuate photo-receptor 56. In other words is the output signal of photo-receptor 56 is a first state indicative of the light beam 57 being detected and a not full level of media in the media output storage area 54 or a second state indicative of the light beam 57 not being detected and a full level of media in the media output storage area 54. When at block B 120 it is determined that photo-receptor 56 has not been actuated by the light beam at a first reduced intensity, method M100 proceeds to block B 140 to report a NOT_FULL media condition and imaging device 20 proceeds with an imaging function rather than causing imaging device 20 to stop. The imaging function may be a new print or scan job or the resumption of a suspended print or scan job. Method M100 to then loops back to block B 120. This loop allows controller 21 to ignore the state of media-full sensor 54 until its has successfully determined that, at the reduced intensity or power level, a light beam sufficient to actuate photo-receptor 56 was seen at photo-receptor 56 so that its output signal meets or exceeds the threshold voltage, i.e., the light beam 57 has been detected. In the loop back to block B120 from block 140, optional block OB142 may be provided after block B 140 to set an error flag to indicate that media-full sensor 54 may need servicing. With the error flag set, at user interface 22, an indicator light 22-1 may be illuminated on user interface 22 or a message may be shown on display 22-2.

When it has been determined that a light beam 57 of sufficient intensity was detected at block B 120, controller 21, at block B 130, will trust the media-full sensor 54 until the next POR cycle, and will report a NOT_FULL media condition. Thereafter, at block B 150, the power to drive light source power is set to produce a light beam at a second intensity that is greater than the first intensity. This second intensity would be considered to be the normal operating intensity, such as for example, a 100 per cent duty cycle for a pulse width modulated drive signal to light source 55, to emit a second or higher intensity light beam 57 that would be used for further checks of media-full sensor 54 until the next occurrence of a POR. If optional block OB 142 is provided, then after block B 130, optional block OB132 may be provided to cancel the error flag if it was set at optional block OB142. This is done because controller 21 can trust the output signal of photo-receptor 56.

After block B 150, method M100 proceeds to block B160 where a determination is made whether or not photo-receptor 56 has detected the second intensity light beam 57 from light source 55. When it has been determined that normal intensity light beam 57 was detected at block B 160, controller 21, at block B 170, will report a NOT_FULL media condition and imaging device 20 will continue with the operation that was occurring prior to the POR. For example, if a print job was being processed, printing would then restart with printed media sheets being fed to the output storage area 52 or to finisher 60. When, at block B 160, it is determined that photo-receptor 56 has not been sufficiently actuated by the second intensity light beam 57, method M100 proceeds to block B180 to report a MEDIA_FULL condition allowing controller 21 of imaging device 20 to suspend or halt the current imaging operation that is sending media to the output storage area 52 until output storage area 52 is emptied to a point that light beam 57 is no longer blocked by the stack 58 of media and the second intensity light beam 57 is again detected. After each of blocks B 170 and B 180, method M100, then loops back to block B160 until the next occurrence of a POR to event. On the occurrence of the next POR event, method M100 would start anew at block B 100.

Using method M100 the truth table for media-full sensor 54 is shown in Table 2.

TABLE 2

| Condition | Reported Value |
|---|---|
| Media storage area is empty | NOT_FULL |
| Media storage area is partially full | NOT_FULL |
| Media storage area is full | NOT_FULL if output bin is full at POR, MEDIA_FULL if output bin is full after POR |
| Light source insufficient intensity; media storage area empty | NOT_FULL |
| Light source at insufficient intensity; media storage area full | NOT_FULL |

Thus, using method M100 allows media-full sensor 54 to fail gracefully while allowing imaging device 20 to continue to operate.

Four operational cases of using method M100 and media-full sensor 54 will now be discussed. Operational Case 1 involves a functioning media-full sensor 54 and imaging device 20 waking from a POR with an empty output media storage area 52. At POR, method M100 will set the power for light source 55 for the first determination of the state of media-full sensor 54 to the reduced power level. It is determined that at the reduced power, photo-receptor 56 was actuated, light source 55 will be set to normal power, and controller 21 and imaging device 20 will trust the media-full sensor 54. Future determinations by controller 21 of the state of photo-receptor 56 will return the actual media storage area level state. Operational Case 2 involves a functioning media-full sensor 54 and imaging device 20 waking from a POR with a full media storage area 52. At POR, method M100 will be unable to tell whether media-full sensor 54 is working, so controller 21 and imaging device 20 will not trust media-full sensor 54 and further determinations made of the state of media-full sensor 54 will return a report of NOT_FULL risking a possible paper jam. However, as soon as a user clears media output storage area 52, the next determination of the state of media-full sensor 54 (the state of the output of photo-receptor 56) will be successful and controller 21 and imaging device 20 will trust media-full sensor 54. Subsequent to determinations of the state of media-full sensor 54 will return the actual state of the media-full sensor 54.

Operational Case 3 involves a failed (or nearly failed) media-full sensor 54, i.e., failed or failing light source 55, and imaging device 20 waking from a POR with an empty media output storage area 52. The initial determination of the state of media-full sensor 54 will fail, and controller 21 and imaging device 20 will not trust media-full sensor 54. Subsequent determinations of the state of media-full sensor 54 will also report NOT_FULL. This may result in paper being ejected onto to the floor or a paper jam during a duplex operation involving a peek-a-boo duplexer; however, imaging device 20 will continue to scan or print.

Operational Case 4 involves a failed or failing media-full sensor 54, i.e., failed or failing light source 55, and the imaging device 20 waking from a POR with a full output storage area 52. The initial determination made after POR will fail, and controller 21 and imaging device 20 will not trust the output signal of media-full sensor 54. Subsequent determinations about the state of the output of photo-receptor 56 will return a report of NOT_FULL. This may result in paper ejected to the floor or a paper jam, but imaging device 20 will print. When a customer clears the media area full condition, the determination of the state of media-full sensor 54 will still fail but will continue to report NOT_FULL.

Figure 4:
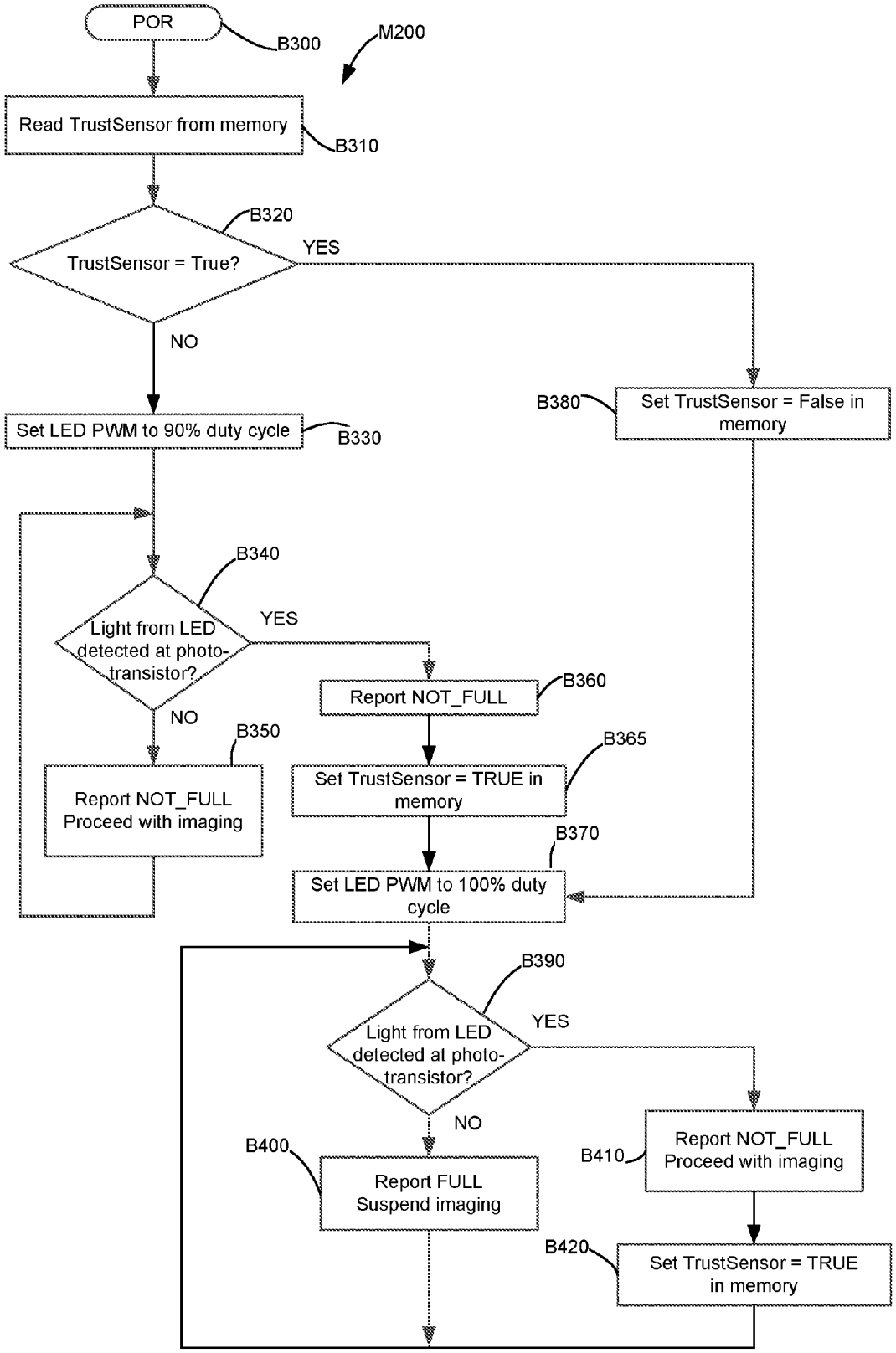
FIG. 4 is a block diagram of another form of a method to provide for a soft fail of a media bin full sensor.

Referring to FIG. 4, method M200 starts whenever the imaging device 20 performs a power on reset (POR) procedure at block B300. A POR occurs as previously described. Media-full sensor 54 includes an LED 55 as light source 55 and a photo-transistor 56 as light receptor 56.

After a POR has been performed at block B300, method M200 reads the state of a variable TrustSensor from memory 23 at block B310. The variable TrustSensor has two values, true and false. At block B320 a determination is made to see whether or not the variable TrustSensor is true. When it is determined that the variable TrustSensor is not true, controller 21 does not trust media-full sensor 54 and method M200 proceeds to block B330 where controller 21 reduces the power level of LED 55 to a predetermined reduced first intensity, such as setting a pulse width modulation drive for LED 55 to a 90 percent duty cycle. Thereafter, at block B340 a determination is made to see whether or not photo-transistor 56 has detected a light beam 57 emitted at the first intensity by LED 55. When it is to determined that the output of photo-transistor 56 does not change state (i.e., the light beam 57 of the first intensity was insufficient to have the output of photo-transistor 56 exceed the threshold value as previously described), method M200 at block B350 reports a NOT_FULL condition to controller 21. There after method M200 loops back to block B340. At block B340, when it is determined the determined that the output of photo-transistor 56 does change state (i.e., the light beam 57 was sufficient to have the output of photo-transistor 56 exceed the threshold value), method M200 proceeds to block B360 where it reports a NOT_FULL condition to controller 21. Thereafter, at block B365 the variable TrustSensor in memory 23 is set to true and then at block B370, controller 21 sets the power or intensity level to 100% for LED 55.

At block B320 when it is determined that the variable TrustSensor is true, method M200 proceeds to block B380 where the variable TrustSensor is set to false and stored in memory 23. Thereafter, method M200 proceeds to block B370 where LED 55 is operated at 100% duty cycle to produce a light beam 57 at a second intensity that is greater than the first intensity. The second intensity would be considered to be the normal operating intensity.

From block B370, method M200 proceeds to block B390 where a determination is made whether or not a light beam at a second intensity from LED 55 has been detected by photo-transistor 56 (the threshold value is exceeded as previously described). When it is determined that the output of photo-transistor 56 does not change state (e.g., the light beam 57 was blocked by the stack 58 of media and the light reaching photo-transistor 56 is of insufficient intensity to have the output signal of photo-transistor 56 exceed the threshold value), method M200 at block B400 reports a FULL condition to controller 21. Thereafter method M200 loops back to block B390. At block B390, when it is determined that the output of photo-transistor 56 does exceed the threshold value, method M200 at block B410 reports a NOT_FULL condition to controller 21 and, at block B420, the variable TrustSensor is set to true in memory 23 and then method M200 loops back to block B390 to redetermine if a light beam at the second intensity has been detected. Method M200 repeats on the next occurrence of a POR.

Again at block B340 when it is determined that the photo-transistor 56 did not detect the light beam 57 from LED 55, an error flag may be set as previously stated. Similarly at block B340 when it is determined that light was detected at photo-transistor 56, the error flag may be cancelled or reset as previously stated.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method of operating an imaging device having a media-full sensor providing an output signal for processing by a controller operatively coupled thereto, the media-full sensor further including a light source and a single photo-receptor mounted at a predetermined height above a floor of a media storage area in the imaging device, the single photo-receptor spaced apart from the light source and positioned to detect a light beam emitted from the light source, the single photo-receptor having an output signal having a first state indicative of detecting the emitted light beam and a not full level of media in the media storage area and a second state indicative of not detecting the emitted light beam and a full level of media in the media storage area, the method comprising:

emitting a first intensity light beam from the light source;

determining whether or not the output signal is one of the first state and second state;

upon determining that the output signal is of the second state:

not trusting the output signal and setting an error flag;

proceeding with an imaging operation; and repeating the determining whether or not the output signal is one of the first state and second state;

upon determining that the output signal is of the first state:

trusting the output signal and emitting a second intensity light beam from the light source, the second intensity light beam of a greater intensity than the first intensity light beam; and, determining for the second intensity light beam whether or not the output signal is one of the first state and the second state;

upon determining that the output signal is of the first state, continuing with a printing operation and, upon determining that the output signal is of the second state, suspending the printing operation;

and, upon occurrence of a power on reset event, repeating the emitting the first intensity light beam.

2. A method of operating an imaging device having a media storage area, the media storage area including a media-full sensor having a light source and a spaced apart single photo-receptor aligned with one another at a predetermined height above a floor of the media storage area, the photo-receptor providing an output signal indicative that the media storage area is one of full of media and not full of media, the method comprising:

emitting from the light source a light beam at a first intensity;

determining whether or not the light beam at the first intensity has been detected by the single photo-receptor;

upon determining that the light beam at the first intensity has not been detected:

not trusting the output signal from the single photo-receptor; and, providing an indication that the media storage area is not full;

and, upon determining that the light beam at the first intensity has been detected:

providing an indication that the media storage area is not full;

emitting a light beam from the light source at a second intensity that is greater than the first intensity;

determining whether or not the light beam at the second intensity have been detected by the single photo-receptor;

upon determining that the light beam of the second intensity has been detected:

trusting the output signal from the single photo-receptor;

proceeding with an imaging operation; and, providing an indication that the media storage area is not full;

upon determining that the beam of the second intensity has not been detected:

providing an indication that the media storage area is full; and, suspending the imaging operation;

and, repeating the determining whether or not the light beam of the second intensity has been detected.

3. The method of claim 2 further comprising, upon determining that the light beam at the first intensity has not been detected, proceeding with an imaging operation.

4. The method of claim 2 wherein the actions of emitting and determining are performed after a power on reset of the imaging device.

5. The method of claim 2 further comprising, upon determining that the light beam of the first intensity level has not been detected, setting an error flag indicating that the media-full sensor requires servicing and proceeding with an imaging operation.

6. The method of claim 5 further comprising, upon determining that the light beam of the first intensity level has been detected, cancelling the error flag.

7. The method of claim 2 wherein the light source is an infrared light source and the single photo-receptor is a photo-transistor.

8. The method of claim 2 further comprising driving the light source with a pulse width modulated drive signal having a duty cycle between about 80 percent to about 90 percent to emit the light beam at the first intensity.

9. The method of claim 2 further comprising driving the light source with a pulse width modulated drive signal having a duty cycle about 100 percent to emit the light beam at the second intensity.

10. A method of operating an imaging device including a media bin having a media-full sensor disposed thereon at a predetermined height above a floor of the media bin, the media-full sensor having a LED on a wall of the media bin and a single photo-transistor spaced apart from the LED source on another wall of the media bin, the method comprising:

performing a power on reset of the imaging device;

reading a value of a variable from a memory of the imaging device, the value being one of true or false; and, upon determining that the read value is false:

emitting a light beam of a first intensity from the LED toward the single photo-transistor; and, determining whether or not the single photo-transistor has detected the light beam of the first intensity;

upon determining that the light beam at the first intensity has not been detected:

not trusting an output signal from the single photo-transistor;

providing an indication that the media bin is not full; and, proceeding with a media imaging operation;

upon determining that the light beam of the first intensity has been detected:

providing an indication that the media bin is not full;

setting the variable in memory to a true value;

emitting a light beam from the light source at a second intensity that is greater than the first intensity; and, determining whether or not the light beam at the second intensity has been detected by the single photo-transistor;

upon determining that the light beam of the second intensity has been detected:

trusting the output signal from the single photo-transistor;

providing an indication that the media bin is not full;

setting the variable to the true value in memory; and proceeding with an imaging operation;

and, upon determining that the beam of the second intensity has not been detected:

providing an indication that the media bin is full; and, suspending the imaging operation.

11. The method of claim 10 wherein, upon determining that the variable read from memory has the true value, setting the variable to a false value in the memory and proceeding to the action of determining whether or not the light beam of the second intensity has been detected.

12. The method of claim 10, wherein the LED and the single photo-transistor are on opposite walls of the media bin.

13. The method of claim 10, wherein the LED and the single photo-transistor are on adjacent walls of the media bin.

14. The method of claim 10, wherein the LED emits an infrared wavelength light beam.

15. The method of claim 10 further comprising driving the LED with a pulse width modulated drive signal having a duty cycle between about 80 percent to about 90 percent to emit the light beam at the first intensity.

16. The method of claim 10 further comprising driving the LED with a pulse width modulated drive signal having a duty cycle about 100 percent to emit the light beam of the second intensity.

17. A method of operating an imaging device including a media bin having a media-full sensor disposed thereon at a predetermined height above a floor of the media bin, the media-full sensor having a LED on a wall of the media bin and a single photo-transistor spaced apart from the LED source on another wall of the media bin, the method comprising:

performing a power on reset of the imaging device;

reading a value of a variable from a memory of the imaging device, the value being one of true or false; and, upon determining that the read value is false:

emitting a light beam of a first intensity from the LED toward the single photo-transistor;

determining whether or not the single photo-transistor has detected the light beam of the first intensity; and upon determining that the light beam at the first intensity has not been detected:

not trusting an output signal from the single photo-transistor;

providing an indication that the media bin is not full;

proceeding with a media imaging operation; and, setting an error flag indicating that the media-full sensor requires servicing.

18. The method of claim 17 further comprising, upon determining that the light beam at the first intensity level has been detected, cancelling the error flag.

* * * * *